United States Patent [19]

Van Steenwyk

[11] Patent Number: 4,706,388

[45] Date of Patent: Nov. 17, 1987

[54] BOREHOLE INITIAL ALIGNMENT AND CHANGE DETERMINATION

[75] Inventor: Donald H. Van Steenwyk, San Marino, Calif.

[73] Assignee: Applied Technologies Associates, San Marino, Calif.

[21] Appl. No.: 768,746

[22] Filed: Aug. 23, 1985

Related U.S. Application Data

[60] Division of Ser. No. 635,612, Jul. 30, 1984, Pat. No. 4,611,405, which is a continuation-in-part of Ser. No. 293,159, Aug. 17, 1981, Pat. No. 4,468,863.

[51] Int. Cl.[4] ..... G01C 19/38

[52] U.S. Cl. ..... 33/304; 33/324

[58] Field of Search ..... 33/304, 302, 312, 313, 33/324

[56] References Cited

U.S. PATENT DOCUMENTS

| | | |
|---|---|---|
| 2,309,905 | 2/1943 | Irwin et al. . |
| 2,635,349 | 4/1953 | Green . |
| 2,674,049 | 4/1954 | James, Jr. . |
| 2,681,567 | 6/1954 | Widess . |
| 2,806,295 | 9/1957 | Ball . |
| 3,037,295 | 6/1962 | Roberson . |
| 3,052,029 | 9/1962 | Wallshein . |
| 3,137,077 | 6/1964 | Rosenthal . |
| 3,241,363 | 3/1966 | Alderson et al. . |
| 3,308,670 | 3/1967 | Granqvist . |
| 3,561,129 | 2/1971 | Johnston . |
| 3,753,296 | 8/1973 | Van Steenwyk . |
| 3,894,341 | 7/1975 | Kapeller . |
| 4,197,654 | 4/1980 | Van Steenwyk . |
| 4,199,869 | 4/1980 | Van Steenwyk . |
| 4,238,889 | 12/1980 | Van Steenwyk . |
| 4,265,028 | 5/1981 | Van Steenwyk . |
| 4,293,046 | 10/1981 | Van Steenwyk . |
| 4,297,790 | 11/1981 | Van Steenwyk . |
| 4,433,491 | 2/1984 | Ott et al. ..... 33/304 X |
| 4,459,760 | 7/1984 | Watson et al. . |

FOREIGN PATENT DOCUMENTS

| | | |
|---|---|---|
| 1306781 | 2/1973 | United Kingdom . |
| 1437125 | 5/1976 | United Kingdom . |
| 2009419 | 6/1979 | United Kingdom . |
| 2027904 | 2/1980 | United Kingdom . |
| 2039371 | 8/1980 | United Kingdom . |
| 2094484 | 9/1982 | United Kingdom . |

*Primary Examiner*—William D. Martin, Jr.
*Attorney, Agent, or Firm*—William W. Haefliger

[57] ABSTRACT

A borehole survey apparatus includes an angular rate sensor, a tilt sensor, a rotary drive to rotate the sensors about an axis extending in the direction of the borehole, circuitry connected with said sensors to determine the azimuthal direction of tilt of the borehole at a first location therein, drive control circuitry and a switch operatively connected with the sensors whereby they may be connected in feedback relation with the rotary drive so that an axis defined by a support for the rate sensor is maintained at predetermined orientation relative to horizontal during travel of the apparatus in a borehole relative to the first location, and integration circuitry connected with the rate sensor whereby changes in borehole alignment during travel may be determined.

10 Claims, 14 Drawing Figures

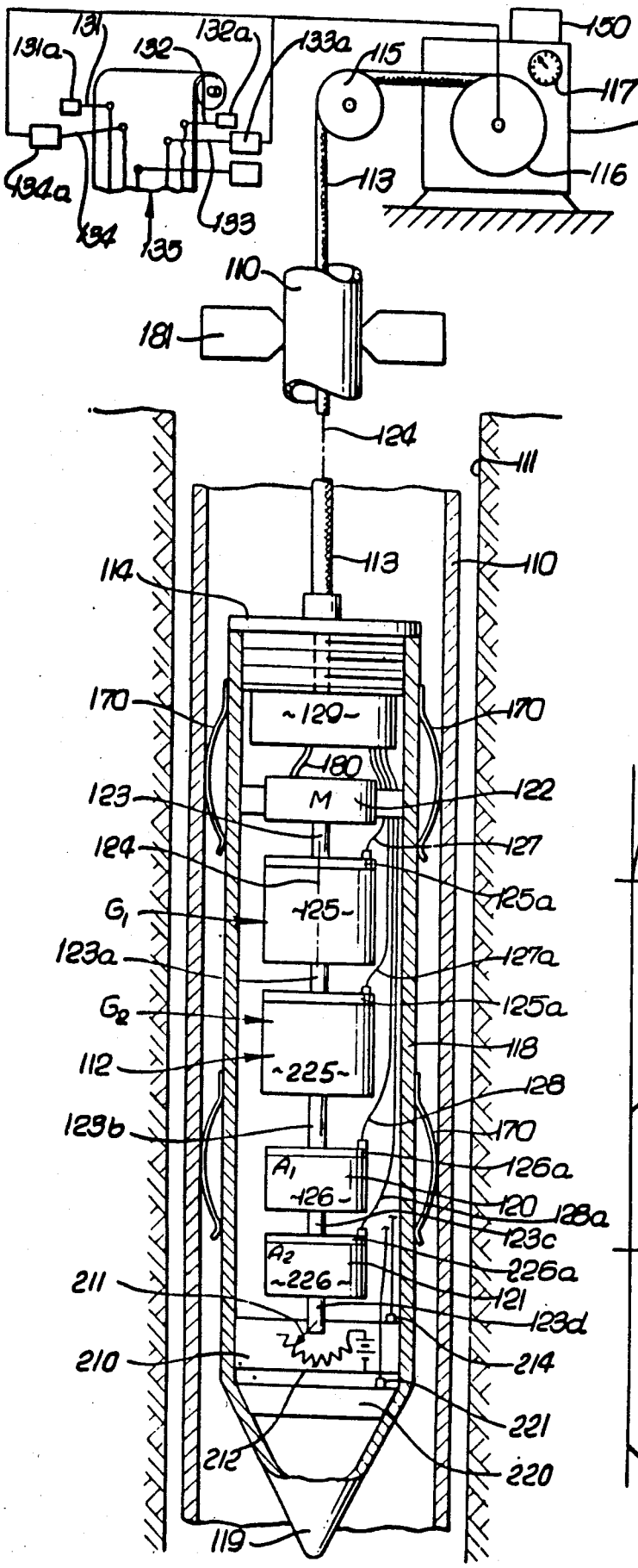
FIG. 6.
FIG. 7.
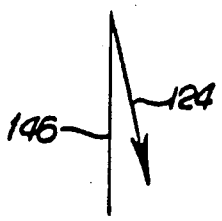
FIG. 8.
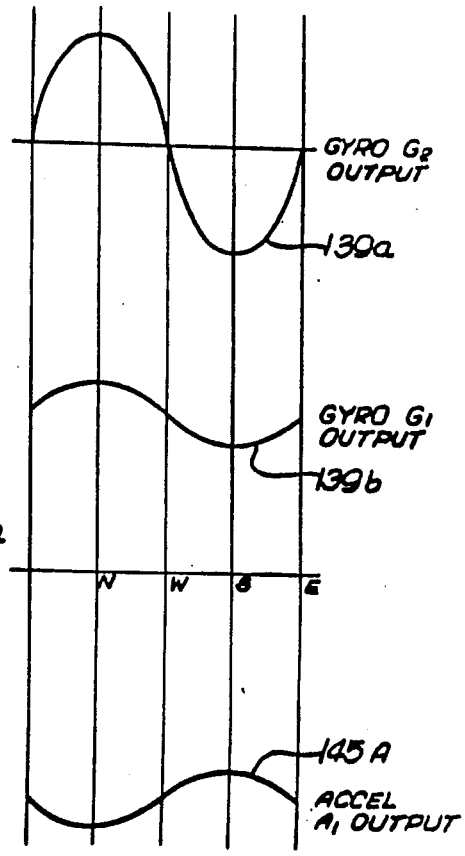

BOREHOLE INITIAL ALIGNMENT AND CHANGE DETERMINATION

This application is a division of Ser. No. 635,612 filed July 30, 1984, now U.S. Pat. No. 4,611,405, which is a continuation-in-part of my prior application Ser. No. 293,159, filed Aug. 17, 1981, and entitled, "High Speed Well Surveying", now U.S. Pat. No. 4,468,863.

BACKGROUND OF THE INVENTION

This invention relates generally to surveying of boreholes, and more particularly concerns methods and apparatus which enable significant reductions in well survey time.

In the past, the task of position mapping a well or borehole for azimuth in addition to tilt has been excessively complicated, very expensive, and often inaccurate because of the difficulty in accomodating the size and special requirements of the available instrumentation. For example, magnetic compass devices typically require that the drill tubing be fitted with a few tubular sections of non-magnetic material, either initially or when drill bits are changed. The magnetic compass device is inserted within this non-magnetic section and the entire drill stem run into the hole as measurements are made. These non-magnetic sections are much more expensive than standard steel drill stem, and their availability at the drill site must be pre-planned. The devices are very inaccurate where drilling goes through magnetic materials, and are unusable where casing has been installed.

Directional or free gyroscopes are deployed much as the magnetic compass devices and function by attempting to remember a pre-set direction in space as they are run in the hole. Their ability to initially align is limited and difficult, and their capability to remember degrades with time and environmental exposure. Also, their accuracy is reduced as instrument size is reduced, as for example becomes necessary for small well bores. Further, the range of tilt and azimuthal variations over which they can be used is restricted by gimbal freedom which must be limited to prevent gimbal lock and consequent gyro tumbling.

A major advance toward overcoming these problems is described in my U.S. Pat. No. 3,753,296. That invention provides a method and means for overcoming the above complications, problems, and limitations by employing that kind and principal of a gyroscope known as a rate-of-turn gyroscope, or commonly 'a rate gyro', to remotely determine a plane containing the earth's spin axis (azimuth) while inserted in a bore-hole or well. The rate gyroscope has a rotor defining a spin axis; and means to support the gyroscope for travel in a bore-hole and to rotate about an axis extending in the direction of the hole, the gyroscope characterized as producing an output which varies as a function of azimuth orientation of the gyroscope relative to the earth's spin axis. Such means typically includes a carrier containing the gyroscope and motor, the carrier being sized for travel in the well, as for example within the drill tubing. Also, circuitry is operatively connected with the motor and carrier to produce an output signal indicating azimuthal orientation of the rotating gyroscope relative to the carrier, whereby that signal and the gyroscope output may be processed to determine azimuth orientation of the carrier and any other instrument thereon relative to the earth's spin axis, such instrument for example comprising a well logging device such as a radiometer, inclinometer, etc.

U.S. Pat. No. 4,192,077 improves upon 3,753,296 in that it provides for use of a "rate gyro" in combination with a free gyroscope, with the rate gyro used to periodically calibrate the free gyroscope. While this combination has certain benefits, it does not provide the unusually advantageous modes of operation and results as are afforded by the present invention. Among these are the enablement of very rapid surveying of boreholes; the lack of need for a free gyroscope to be periodically calibrated; and reduction in time required for surveying slanted boreholes, of particular advantage at depths where high temperatures are encountered.

SUMMARY OF THE INVENTION

It is a major object of the invention to provide method and apparatus facilitating rapid surveying of boreholes, as referred to. Typically, the survey method employs first means for measuring angular rate, and second means for sensing tilt, said means having sensitive axes, a rotary drive for the first and second means, and circuitry to process outputs of the sensors and to control the drive the basic steps of the method including:

(a) operating the drive and the first and second means at a first location in the borehole, and also operating said circuitry, to produce signals used to determine the azimuthal direction of tilt of the borehole at such location, (b) when traveling the first and second means and the drive lengthwise of the borehole away from the location, and operating the drive and at least one of the first and second means during such traveling and also operating said circuitry, to produce signals used to determine changes in borehole alignment during traveling, (c) and maintaining at least one of said sensitive axes at a predetermined orientation relative to horizontal during said travel.

As will be seen, the (c) step of the method typically involves maintaining an input axis defined by the second means at a predetermined orientation (such as horizontal) during traveling, the drive being controlled to accomplish this. For example, the first means may include first and second gyroscopes, one having its input axis maintained horizontal during such travel. Accordingly, if the borehole changes its direction of tilt during instrumentation travel, the one gyroscope detects the amount of change; in addition, the second gyroscope senses changes in azimuth during the travel between upper and lower positions in the well. Further, the (a) step of the method may be carried out at each of the upper and lower positions prior to and subsequent to such travel, for accurately determining azimuthal direction of tilt of the hole at such locations. These (a) and (b) steps may be carried out in alternation, up or down the hole, to enable rapid surveying, as will be seen.

Apparatus embodying the invention comprises:

(a) angular rate sensor means having a sensitive axis, (b) tilt sensor means, (c) a rotary drive operatively connected to said (a) and (b) sensor means to rotate same about an axis extending generally in the direction of the borehole, (d) and circuitry operatively connected with said (a) and (b) sensor means to determine the azimuthal direction of tilt of the borehole at a first location therein, said (a) sensor means also connected in feedback relation with the drive whereby the sensitive axis of the (a) sensor means is maintained at a predetermined orientation relative to horizontal during travel of said apparatus in the borehole relative to said first location, and whereby changes in borehole alighment during said travel may be determined.

These and other objects and advantages of the invention, as well as the details of illustrative embodiments, will be more fully understood from the following description an drawings, in which:

DRAWING DESCRIPTION

FIG. 1 is an elevation taken in section to show one form of instrumentation employing the invention;

FIG. 1*a* is a circuit diagram;

FIG. 6 is a vertical section showing further details of the FIG. 1 apparatus as used in a borehole;

FIG. 7 is a diagram indicating tilt of the apparatus in a slanted borehole;

FIG. 8 is a waveform diagram;

Figure 1:
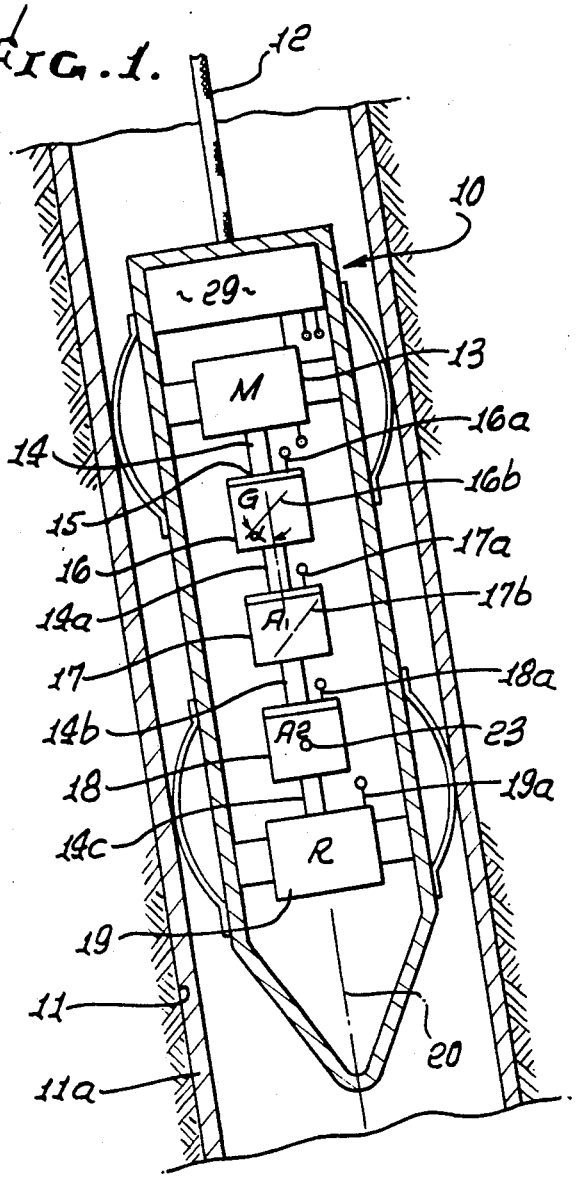
Figure 1:
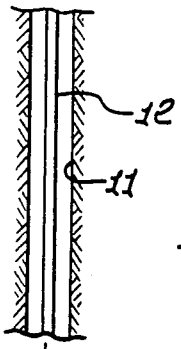
Figure 1A:
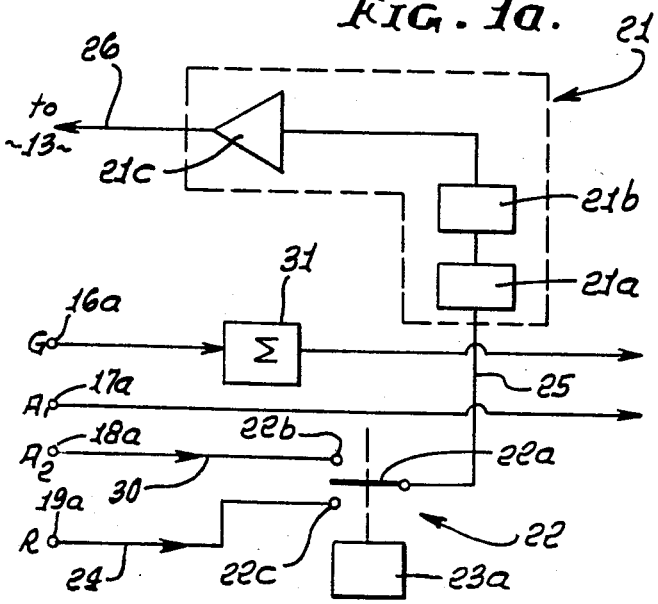
Figure 1B:
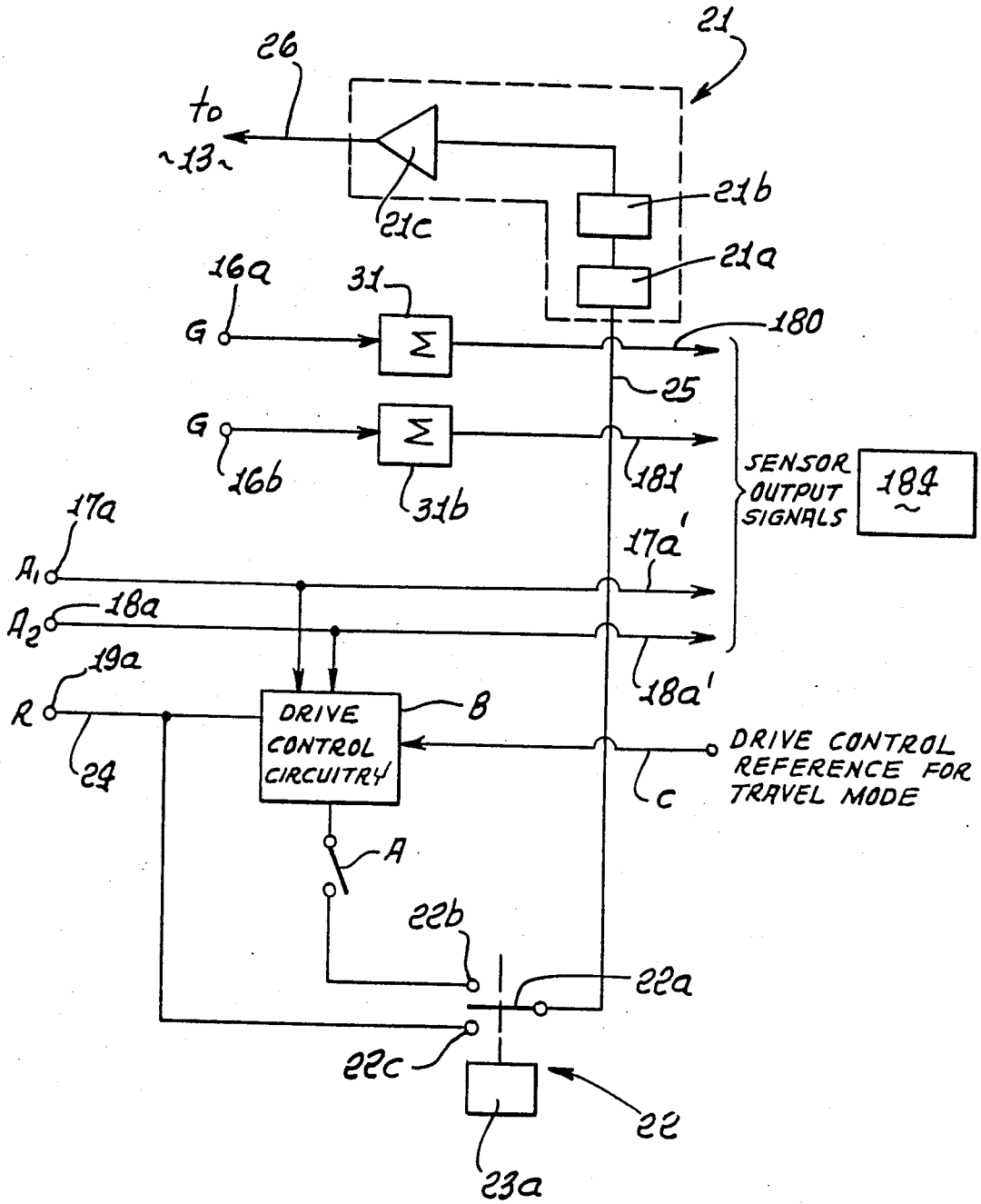
Figure 1C:
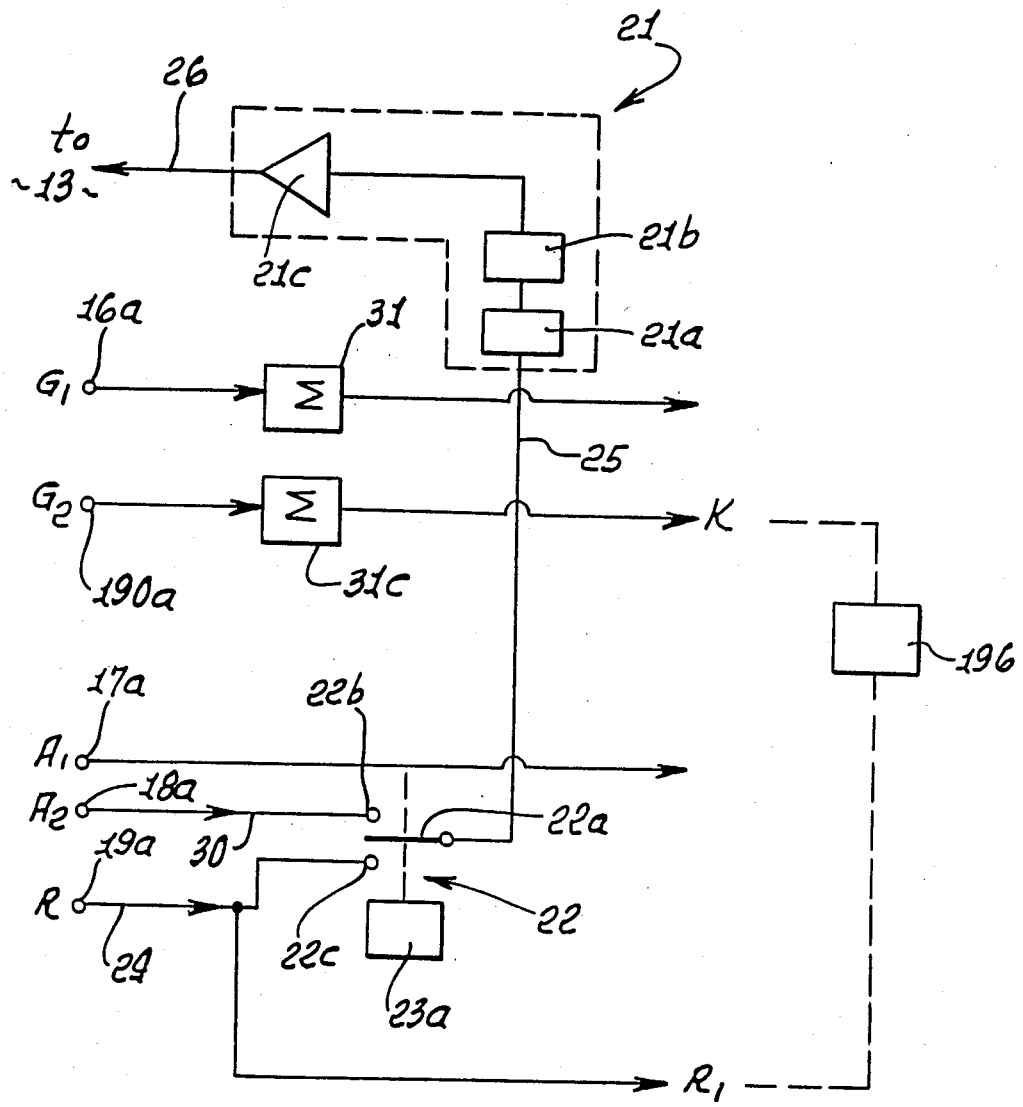

FIGS. 1*b* and 1*c* are modification associated circuit diagrams.

DETAILED DESCRIPTION

Referring to FIG. 1, a carrier such as elongated housing 10 is movable in a borehole indicated at 11, the hole being cased at 11*a*. Means such as a cable to travel the carrier lengthwise in the hole is indicated at 12. A motor or other manupulatory drive means 13 is carried by and within the carrier, and its rotary output shaft 14 is shown as connected at 15 to an angular rate sensor means 16. The shaft may be extended at 14*a*, 14*b* and 14*c* for connection to first acceleration sensor means 17, second acceleration sensor means 18, and a resolver 19. The accelerometers 17 and 18 can together be considered as means for sensing tilt. These devices have terminals 16*a*–19*a* connected via suitable slip rings with circuitry indicated at 29 carried within the carrier (or at the well surface, if desired).

Figure 2:
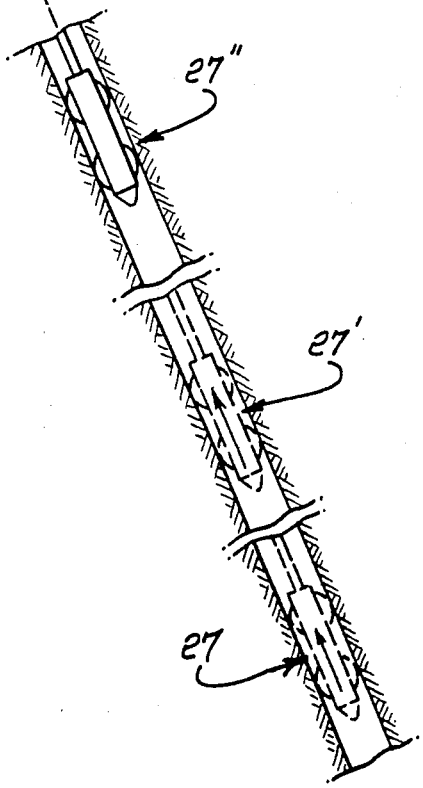
FIG. 2 is an elevation showing use of the FIG. 1 instrumentation in multiple modes, in a borehole.

Circuitry 29 typically may include a feed back arrangement as shown in FIG. 1*a*, and incorporating a feed back amplifier 21, a switch 22 having arm 22*a* and contacts 22*b* and 22*c*, and switch actuator 23*a*. When the actuator closes arm 22*a* with contact 22*c*, the resolver 19 is connected in feed back relation with the drive motor 13 via leads 24, 25, and 26, and amplifier 21, and the apparatus operates for example as described in U.S. Pat. No. 3,753,296 to determine the azimuthal direction of tilt of the bore hole at a first location in the bore hole. See for example first location indicated at 27 in FIG. 2. Other U.S. patents describing such operation are Nos. 4,199,869, 4,192,077, & 4,197,654. During such operation, the motor 13 rotates the sensor 16 and the accelerometers either continuously, or incrementally.

The angular rate sensor 16 may for example take the form of one or more of the following known devices, but is not limited to them:

1. Single degree of freedom rate gyroscope
2. Tuned rotor rate gyroscope
3. Two axis rate gyroscope
4. Nuclear spin rate gyroscope
5. Sonic rate gyroscope
6. Vibrating rate gyroscope
7. Jet stream rate gyroscope
8. Rotating angular accelerometer
9. Integrating angular accelerometer
10. Differential position gyroscopes and platforms
11. Laser gyroscope
12. Combination rate gyroscope and linear accelerometer Each such device may be characterized as having a "sensitive" axis, which is the axis about which rotation occurs to produce an output which is a measure of rate-of-turn, or angular rate $\omega$. That value may have components $\omega_1$, $\omega_2$ and $\omega_3$ in a three axis co-ordinate system. The sensitive axis may be generally normal to the axis 20 of instrument travel in the bore hole, or it may be canted at some angle $\alpha$ relative to axis 20 (see canted sensitive axis 16*b* in FIG. 1).

Figure 3:
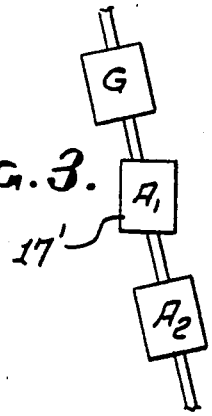
FIG. 3 is a schematic elevation showing a modification of FIG. 1 instrumentation.

The acceleration sensor means 17 may for example take the form of one or more of the following known devices; however, the term "acceleration sensor means" is not limited to such devices:

1. one or more single axis accelerometers
2. one or more dual axis accelerometers
3. one or more triple axis accelerometers Examples of acceleration sensors include the accelerometers disclosed in U.S. Pat. Nos. 3,753,296 and 4,199,869, having the functions disclosed therein. Such sensors may be supported to be orthogonal or canted at some angle $\alpha$ relative to the carrier axis. They may be stationary or carouseled, or may be otherwise manipulated, to enhance accuracy and/or gain and added axis or axes of sensitivity. The sensor 17 typically has two output axes of sensitivity. A canted axes of sensitivity is seen at 17*b* in FIG. 1, and a canted accelerometer 17' (corresponding to accelerometer 17 in FIG. 1) is seen in FIG. 3. The axis of sensitivity is the axis along which acceleration measurement occurs.

The second accelerometer 18 may be like accelerometer 17, excepting that its input axis 23 is typically orthogonal to the input axes of the sensor 16 and of the accelerometer 17. During travel mode, i.e. lifting or lowering of the carrier 10 in the borehole 11, indicated at 27' in FIG. 2, the output of the second accelerometer 18 is connected via lead 30 (in FIG. 1*a*), contact 22*b*, switch arm 22*a*, and servo amplifier 21 to the drive motor 13. The servo system causes the motor to rotate the shaft 14 until the input axis 23 of accelerometer is horizontal (assuming that the borehole has tilt as in FIG. 2). Typically, there are two such axis 23 horizontal positions, but logic circuitry in the servo-system may for example cause rotation until the output of acceleration sensor 18 is positive. Amplifier 21 typically includes signal conditioning circuits 21*a*, feedback compensation circuits 21*b*, and power amplifier 21*c* driving the motor M shown at 13.

If, for example, the borehole is tilted 45° due East at the equator, accelerometer 17 would register +0.707 g or 45°, and the angular rate sensor 16 would register no input resulting from the earth's rate of rotation. If, then, the apparatus is raised (or lowered) in the borehole, while input axis 23 of accelerometer 18 is maintained horizontal, the output from accelerometer 17 would remain constant, assuming the tilt of the borehole remains the same. If, however, the hole tilt changes direction (or its elevation axis changes direction) the accelerometer 17 senses such change, the amount of such change being recorded at circuitry 29, or at the surface. If the hole changes its azimuth direction during such instrument travel, the sensor 16 senses the change, and the sensor output can be integrated as shown by integrator circuit 31 in FIG. 1*a* (which may be incorporated in circuitry 29, or at the surface) to register the angle of azimuth change. The instrumentation can be traveled at high speed along the tilted borehole while recording such changes in tilt and azimuth, to a second position (see position 27" in FIG. 2). At that position, the instrumentation is again operated as at 27 (mode #1) to accurately determine borehole tilt and azimuth—essentially a re-calibration step. Thus, the apparatus can be traveled hundreds or thousands of feet, operating in mode #2 as described, and between calibration positions at which travel is arrested and the device is operated in mode #1.

The above modes of operation are typically useful in the tilted portion of a borehole; however, normally the main i.e. lower portion of the oil or gas well is tilted to some extent, and requires surveying. Further, this part of the hole is typically at relatively high temperature where it is desirable that the instrumentation be moved quickly to reduce exposure to heat, the invention lending itself to these objectives. In the vertical or near vertical (usually upper) portion of the hole, the instrumentation can revert to mode #1 operation, at selected positions, as for example at 100 or 200 foot intervals. In a near vertical hole, azimuth contributes very little to hole position computation, so that mode #1 positions can be spaced relatively far apart, and thus this portion of the hole can be mapped rapidly, as well.

Figure 4:
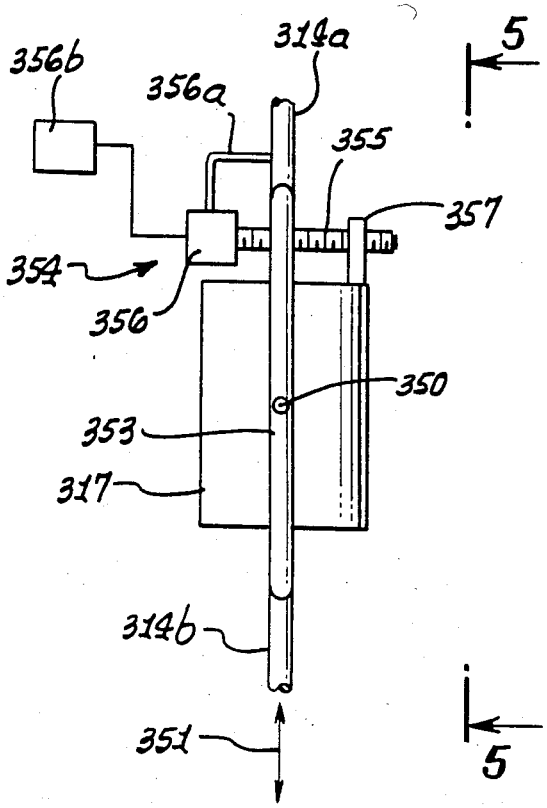
FIG. 4 is a fragmentary elevation showing variable cant mechanism as usable in the FIG. 1 instrumentation.
Figure 5:
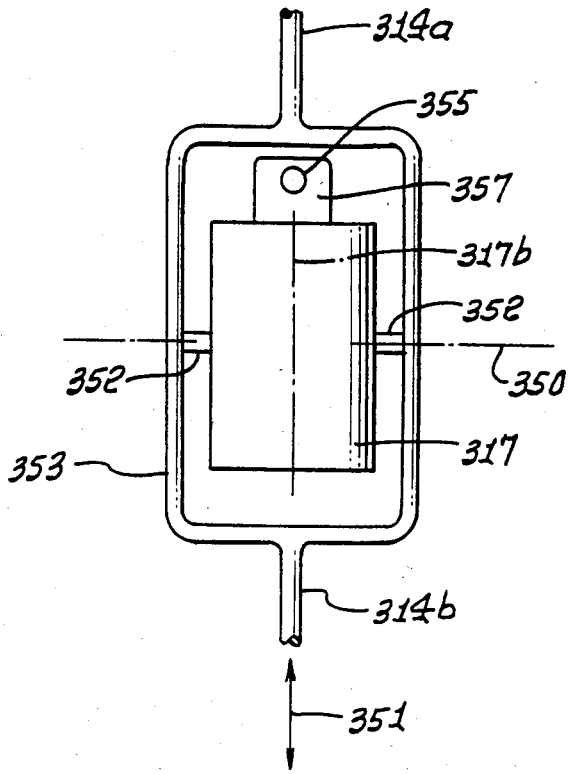
FIG. 5 is a side view taken on lines 5—5 of FIG. 4.

FIGS. 4 and 5 illustrate technique for adjusting the angularity of the axis of sensitivity of the first accelerometer relative to the lengthwise direction of instrument travel in the borehole. As shown, the accelerometer 317 (corresponding to accelerometer 17) has an axis of sensitivity (input axis) shown at 317*b*, which is rotatable about an axis 350 which is substantially normal to the direction of travel 351 in the borehole. Shaft extensions 314*a* and 314*b* correspond to extensions 14*a* and 14*b* in FIG. 1. The accelerometer 317 is carried by pivots 352 in a frame 353 to which shaft extensions 314*a* and 314*b* are connected, as shown. Control means 354 is also carried by the frame to adjust the cant of axis 317*b*, as for example at locations of mode #1 operation as described above, to improve the determination of azimuthal direction of tilt of the borehole, at such "calibration" locations, and/or at other instrument locations in the hole. The control means 354 may, for example, comprise a jack screw 355 driven by a reversible motor 356 suspended at 356*a* by the frame. The jack screw extends laterally and interfits a nut 357 attached to the accelerometer case, as for example at its top, offset from axis 350. A servo system 356*b* for the drive may be employed, so that a chosen angularity of axis 317*b* relative to direction 351 may be achieved. Support or suspension 356*a* may be resiliently yieldable to allow the accelerometer to be adjustably tilted, without jamming of the drive or screw.

FIGS. 6–8 show in more detail the apparatus of FIG. 1, and associated surface apparatus. In FIG. 6, well tubing 110 extends downwardly in a well 111, which may or may not be cased. Extending within the tubing is a well mapping instrument or apparatus 112 for determining the direction of tilt, from vertical, of the well or borehole. Such apparatus may readily be traveled up and down in the well, as by lifting and lowering of a cable 113 attached to the top 114 of the instrument. The upper end of the cable is turned at 115 and spooled at 116, where a suitable meter 117 may record the length of cable extending downwardly in the well, for logging purposes.

The apparatus 112 is shown to include a generally vertically elongated tubular housing or carrier 118 of diameter less than that of the tubing bore, so that well fluid in the tubing may readily pass, relatively, the instrument as it is lowered in the tubing. Also, the lower terminal of the housing may be tapered at 119, for assisting downward travel or penetration of the instrument through well liquid in the tubing. The carrier 118 supports first and second angular sensors such as rate gyroscopes $G_1$ and $G_2$, and accelerometers 120 and 121, and drive means 122 to rotate the latter, for travel lengthwise in the well. Bowed springs 170 on the carrier center it in the tubing 110.

The drive means 122 may include an electric motor and speed reducer functioning to rotate a shaft 123 relatively slowly about a common axis 124 which is generally parallel to the length axis of the tubular carrier, i.e. axis 124 is vertical when the instrument is vertical, and axis 124 is tilted at the same angle form vertical as is the instrument when the latter bears sidewardly against the bore of the tubing 110 when such tubing assumes the same tilt angle due to borehole tilt from vertical. Merely as illustrative, for the continuous rotation case, the rate of rotation of shaft 124 may be within the range 0.5 RPM to 5 RPM. The motor and housing may be considered as within the scope of means to support and rotate the gyroscope and accelerometers.

Due to rotation of the shaft 123, and lower extensions 123*a*, 123*b* and 123*c* thereof, the frame 125 and 225 of the gyroscope and the frames 126 and 226 of the accelerometers are typically all rotated simultaneously about axis 124, within and relative to the sealed housing 118. The signal outputs of the gyroscopes and accelerometers are transmitted via terminals at suitable slip ring structures 125*a*, 225*a*, 126*a* and 226*a*, and via cables 127 127*a*, 128 and 128*a*, to the processing circuitry at 129 within the instrument, such circuitry for example including that described above, and multiplexing means if desired. The multiplexed or nonmultiplexed output from such circuitry is transmitted via a lead in cable 113 to a surface recorder, as for example include pens 131–134 of a strip chart recorder 135, whose advancement may be synchronized with the lowering of the instrument in the well. The drivers 131*a*–134*a* for recorder pens 131–134 are calibrated to indicate borehole azimuth, degree of tilt and depth, respectively, and another strip chart indicating borehole depth along its length may be employed, if desired. The recorder can be located at the instrument for subsequent retrieval and read-out after the instrument is pulled from the hole.

The angular rate sensor 16 may take the form of gyroscope $G_1$ or $G_2$, or their combination, as described in U.S. Pat. No. 4,199,869. Accelerometers 126 and 226 correspond to 17 and 18 in FIG. 1.

Figure 9:
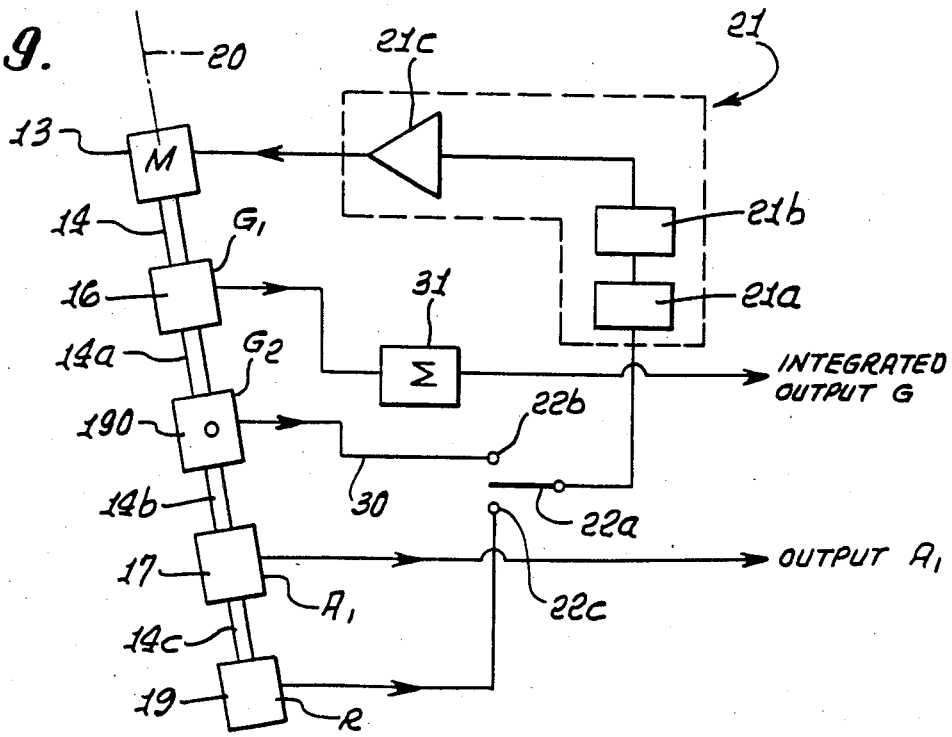
FIG. 9 is a block diagram showing modified apparatus.

In FIG. 9 the elements 13, 16, 17 and 19 are the same as in FIG. 1; however, the second accelerometer 18 of FIG. 1 is replaced by a second angular rate sensor 190 (such as gyroscope $G_2$) having one of its axes of sensitivity along the borehole axis, which serves the same function as the second accelerometer 18. Thus, the angular rate sensor 190 maintains a gimbal axis fixed (as for example horizontal or at any other desired orientation) during instrumentation travel in mode #2, and its output is connected via the servo loop 22b, 22a and amplifier 21 to the drive motor 13, so that if the hole changes direction in tilt, during such travel, accelerometer 17 will sense the amount of change, for recordation. The output of gyroscope 190 may equivalently be provided by the second axis of a two input axis first gyroscope, the other input axis of which is also provided by the first gyroscope. The second accelerometer, 18, of FIG. 1 could be added to the configuration of FIG. 9 if a second orthogonal signal normal to the borehole axis is desired, and is shown for that purpose as having output $A_2$ in FIG. 10.

Figure 11:
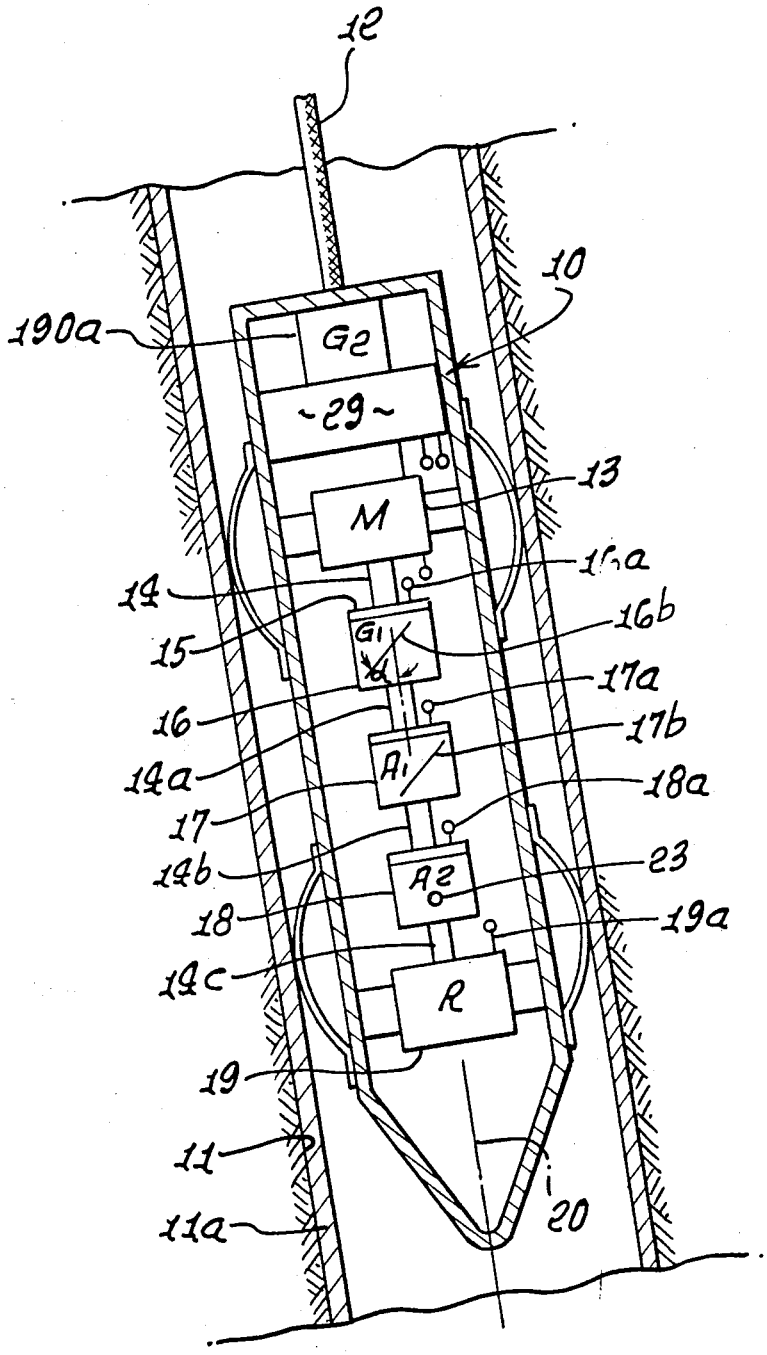

FIG. 11 shows an alternative approach to that of FIG. 9 that has unique advantages in certain applications. The second gyroscope $G_2$ may alternatively be mounted directly on the carrier (10 in FIG. 11), as indicated at 190a and may have its output (proportional to angular rate sensed about the borehole axis) integrated by integrator 31c (FIG. 1c) to provide a measurement of the rotation of the carrier, 10, about the borehole axis. This output measurement at K may then be combined, at 196 with the output signal $R_1$ from the resolver, 19, carried by line, 24, (FIG. 1c) to determine angle of shaft 14 with respect to inertial space. Thus, gyroscope $G_2$ is further characterized as having an axis of input rate sensitivity along the borehole direction and an output signal which is integrated to determine changes in the orientation of said carrier frame about an axis along the borehole direction.

Either angular rate sensor $G_1$ or $G_2$ of FIG. 9 may have a second axis of input rate sensitivity nominally orthogonal to the borehole axis, 124, and the first input axis of angular rate sensor 16. In this case, as represented in FIG. 1b, two angular rate signal outputs as at 180 and 181 and two tilt sensitive signal outputs (as at 17a' and 18a') from those axes nominally orthogonal to the borehole axis may be combined and used together as at circuitry 184 to determine changes in the borehole inclination and azimuth while traveling, without requiring the use of the rotary drive mechanism to adjust any input axis to a horizontal or other known position. The drive mechanism may then be left disconnected as by opening switch A, while traveling, unless use of the drive is desired to lock the gimbal to the case, or to control the rotation of the gimbal during travel, so as to reduce sensor errors.

In FIG. 1b, the options for use of the drive mechanism are shown when the second angular rate sensor axis is associated with $G_1$, i.e. 16. Changes from FIG. 1a include integration circuit 31b, provision of a switch, A, to disable the drive mechanism during traveling if desired, and provision of drive control circuitry, B. The latter may employ inputs from both tilt sensor axes, 17a and 18a, the gimbal resolver, 19a, and an external drive control reference, C, to permit any desired control of the drive mechanism during travel if the drive mechanism is not disabled by switch A.

Figure 10:
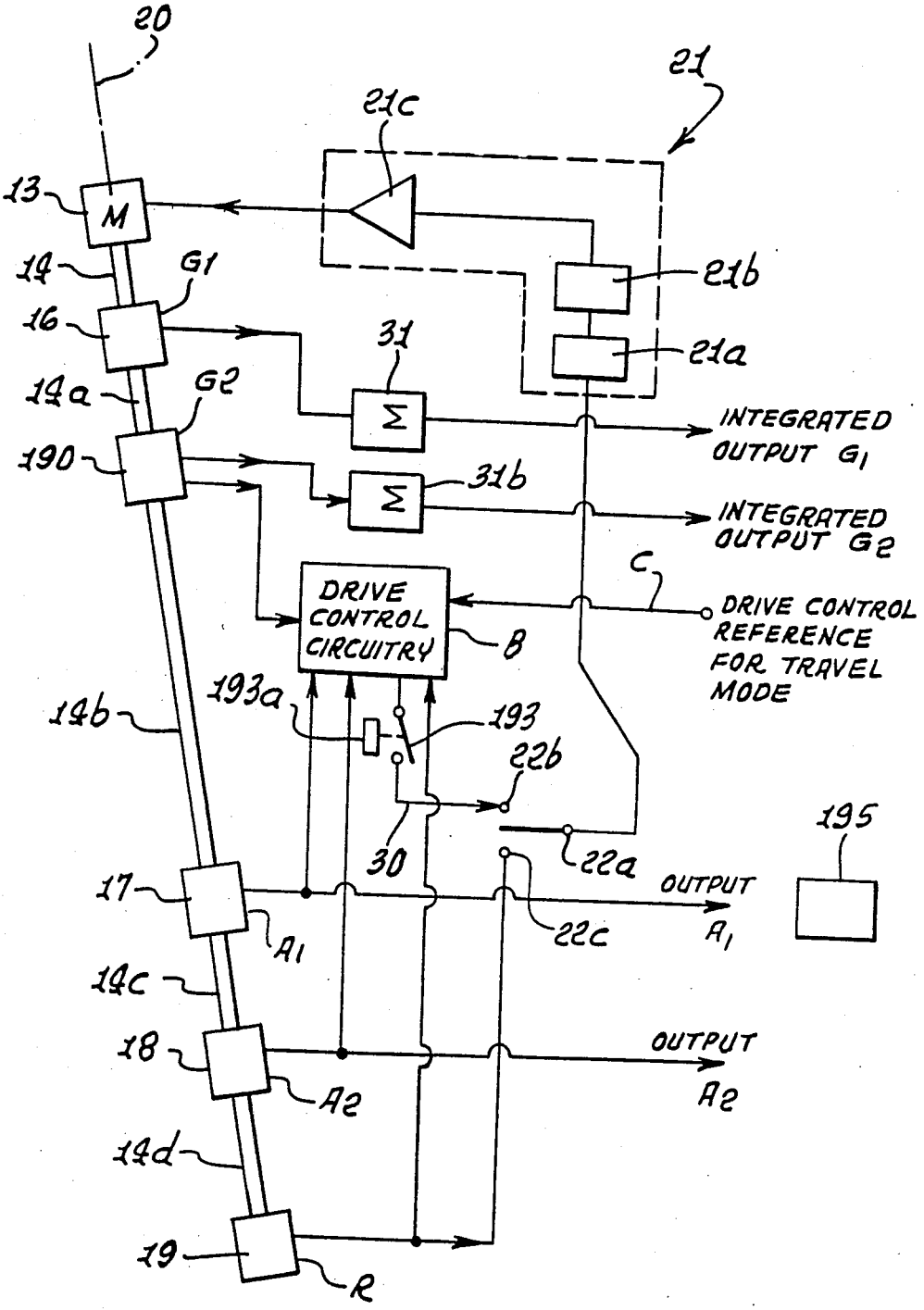
FIGS. 10 and 11 show modifications.

In FIG. 10, the options for use of the drive mechanism are shown when the second angular rate sensing axis is associated with $G_2$, i.e. 190. Changes from FIG. 9 include integration of the second output signal of $G_2$ in integrator 31b, addition of the second tilt sensor $A_2$, 18, from FIG. 1 to get the second orthogonal tilt output signal, 193, and control 193a therefor to enable disabling of the drive mechanism during traveling, and provision of drive control circuitry, B, which receives inputs from tilt sensors $A_1$ and $A_2$ i.e. 17 and 18, angular rate sensor $G_2$, i.e. 190, the gimbal resolver, 19, and an external drive control reference, C, to permit any desired control of the drive mechanism during traveling if the drive mechanism is not disabled by switch 193. The latter is connected between circuitry B and contact 22b.

I claim:

1. In borehole survey apparatus, the combination comprising:

(a) angular rate sensor means having a sensitive axis, (b) tilt sensor means, (c) a rotary drive operatively connected to said rate sensor means and said tilt sensor means to rotate said rate sensor means and said tilt sensor means about an axis extending generally in the direction of the borehole, (d) circuitry operatively connected with said rate sensor means and said tilt sensor means to determine the azimuthal direction of tilt of the borehole at a first location therein, (e) drive control circuitry and switch means operatively connected with said rate sensor means and said tilt sensor means whereby said rate sensor means and said tilt sensor means may also be connected in feedback relation with the drive whereby an axis defined by a support for the rate sensor means is maintained at a predetermined orientation relative to horizontal during travel of said apparatus in the borehole relative to said first location, (f) and integration circuitry connected with said rate sensor means whereby changes in borehole alignment during said travel may be determined.

2. The apparatus of claim 1 wherein said (a) sensor means includes first and second angular rate sensors, said apparatus including a carrier frame carrying said second rate sensor which has an axis of input rate senstivity along the direction of the borehole, and an output, said circuitry connected to integrate said output to determine changes in the orientation of said carrier frame about an axis extending along the borehole direction.

3. The apparatus of claim 1 wherein said rate sensor means includes first and second angular rate sensors, the second angular rate sensor connected in feedback relation with the drive.

4. The apparatus of claim 3 wherein said second angular rate sensor comprises a gyroscope, and said sensitive axis is a sensitive axis of the gyroscope.

5. The apparatus of claim 2 wherein said rate sensor means comprise first and second gyroscope, at least one of which is rotated by said rotary drive.

6. The apparatus of claim 1 including a carrier for said rate sensor and tilt sensor, means and drive, and movable lengthwise in the borehole.

7. The apparatus of claim 6 including a cable suspending said carrier in the borehole for lengthwise travel therein.

8. The apparatus of claim 6 including second angular rate sensor means carried by the carried to be free of rotation by said drive.

9. The apparatus of claim 1 including a resolver having a first element connected with the carrier and a second element connected to be rotated by the drive, the relative positions of said elements determining an output, the rate sensor means including first and second angular rate sensors, the second angular rate sensor also having an output which is integrated, and means to receive said outputs of the resolver and second angular rate sensor to determine the angle of the rotary drive with respect to inertial space.

10. The apparatus of claim 1 including a resolver operatively connected with said tilt sensor means and with a drive control reference signal to obtain a desired gimbal motion of the drive during said traveling.

* * * * *